United States Patent [19]

Roberts et al.

[11] Patent Number: 4,506,595

[45] Date of Patent: Mar. 26, 1985

[54] MODULAR WALL AND CEILING SYSTEM

[76] Inventors: Graham S. Roberts, 24 Church Hill, Camberley; David T. Smith, "Rudwicks" Rudwicks Close, Felpham, Bognor Regis; Brian J. Woolsey, "Sunnyside", Surbiton Golf Course, Woodstock La., S. Chessington, all of England

[21] Appl. No.: 380,706

[22] Filed: May 21, 1982

[30] Foreign Application Priority Data

May 26, 1981 [GB] United Kingdom ..... 8115964

[51] Int. Cl.[3] ..... F24F 7/10

[52] U.S. Cl. ..... 98/31; 98/31.5

[58] Field of Search ..... 98/31, 33 R, 33 A

[56] References Cited

U.S. PATENT DOCUMENTS

| | | | |
|---|---|---|---|
| 2,815,938 | 12/1957 | Impey et al. | 98/31 X |
| 3,115,819 | 12/1963 | Mahlmeister et al. | 98/31 X |
| 3,522,724 | 8/1970 | Knab | 98/33 A |
| 3,789,747 | 2/1974 | Wasserman et al. | 98/31 |

FOREIGN PATENT DOCUMENTS

| | | | |
|---|---|---|---|
| 1912020 | 10/1969 | Fed. Rep. of Germany . | |
| 2215597 | 10/1973 | Fed. Rep. of Germany . | |
| 2856074 | 7/1980 | Fed. Rep. of Germany . | |
| 82039 | 7/1978 | Japan | 98/33 A |
| 504255 | 4/1939 | United Kingdom . | |
| 920688 | 4/1939 | United Kingdom . | |

OTHER PUBLICATIONS

"Clean Rooms"-Solid State Technology: The Electronic Manufacturer's Journal, vol. 13, No. 7, Jul. 1970, Port Washington, N.Y. (USA).

*Primary Examiner*—Harold Joyce

*Attorney, Agent, or Firm*—Merchant, Gould, Smith, Edell, Welter & Schmidt

[57] ABSTRACT

A wall and ceiling construction system for use in the construction of rooms which can be kept in a sterile and dust free state comprises wall panels having a double skin construction with an air space between opposite skins thereof, the panels being secured together at upstanding marginal regions, possibly with the interposition of fixing posts. The panels include a number of panels which have at least one duct inlet thereinto for communicating the room interior via the interior of the panels with extraction ducts above ceiling level at air outlet spigots. The panels are coved at their transition between the walls and a base of greater width than the thickness of the panel. Depending upon the manner of provision of the duct inlets, in addition to achieving conventional air flow into floor level air inlets directly within the room, it is possible to achieve horizontal air flow or vertical air flow within the room.

13 Claims, 38 Drawing Figures

A
3
18
8
300

A
3
8
8
19
300

22

20
17
17
18
1a
1b
22
19
21
21
19
22

MODULAR WALL AND CEILING SYSTEM

This invention relates to a modular wall and ceiling construction system for use in the construction of rooms which can readily be rendered sterile and dust free and kept sterile and dust free and are accordingly suitable for use in those fields in which requirements exist for such conditions, in particular in the pharmaceutical, electronic, biochemical, chemical, atomic energy, food processing, optics, aerospace, photographic and dairy industries as well as in the medical sphere and in hospitals, for example in operating theatres.

According to the present invention, there is provided, for forming a room construction, a plurality of ceiling panels and a plurality of integrally moulded rigid wall panels having a double skin construction with an air space between opposite skins thereof, which panels are intended to be secured together at upstanding marginal regions, there being included among the wall panels a plurality of panels each having at least one duct inlet thereinto for communicating the room interior via the interior of the panels with extraction ducts above ceiling level, which panels are coved at their base edges to provide a rounded surface transition from wall to floor within the room.

In addition to separating one room or area from another, the wall panels for forming a room construction of the invention enable, as a result of their double skin construction, air to be extracted from within the room to air extraction ducting above ceiling level allowing for possible recirculation to the room in a closed system incorporating appropriate filters. The room construction will include one or more panels or uprights having provision for the fitting of doors whose frames can optionally be entirely above the coving level so that the smooth wall to floor transition is maintained at all points around the room. Some of the wall panels can be of modified construction, similar to window constructions, to enable knock-out emergency exit panels to be fitted therein.

In practice, it will be the majority if not all of the panels not provided with such fittings as doors or knockout panels which will provide the aforementioned air circulation facility. For this purpose, they will usually have an air intake duct at floor level for extraction of air and dust in the room at the position where dust concentration is likely to be most intense. The air extraction duct from above the ceiling can optionally be coupled to a common air conditioning or heating and ventilating duct or can be linked to independent air conditioning or heating and ventilation plants for each of the rooms created by the panelling.

The type of air flow achievable with a room construction embodying the invention may be of one of three types:

1. Conventional air flow where air is fed into the room through a filter in the ceiling thereof and removed from the room at air extract ducts as aforesaid positioned at floor level.

2. Horizontal air flow, where air passes unidirectionally across the room via a bank of filters in one wall to a wall face on the opposite side of the room made up of perforated wall panels.

3. Vertical air flow wherein air is admitted through a ceiling filter bank. A perforated false floor with a coved transition occurring between it and the wall panels is positioned in the room space above floor level. Air entering the room passes downwardly through the performations in the false floor into a sub-floor area to enter air intake ducts as aforesaid at sub-floor level and to pass up through the double skinned wall panels to above ceiling level to be returned to a fan.

The individual wall units may either be bolted directly to one another or supported by a combination of vertical posts fixed to the floor on a grid spacing with support brackets rigidly fixing panel unit to adjacent panel unit. Such vertical posts are hidden behind service panels which are likewise coved at their transition to the floor and ceiling. The service panels provide the service of connecting the profiles of the main panels either side and allow mechanical/electrical services to be brought down (or up) to the room.

Although all of the wall panels with the exception of those which have provision for doors or knock-out panels may include air intake ducts, these will generally be provided at only one skin. The panels can accordingly be handed which allows a single wall panel thickness of wall to be provided between adjacent rooms in a multi-room construction with the facility for air extraction being provided in each room to individual or common duct systems by handling of the panels so that for example alternate main wall panels provide extraction facility from one room with the intermediate panels facing the other way providing a like facility in the adjacent room.

For a better understanding of the invention and to show how the same can be carried into effect, reference will now be made, by way of example only, to the accompanying drawings wherein:

FIG. 1A, 1B and 1C respectively show in elevation, vertical cross-section and plan view one form of wall panel incorporating a floor level air extracting duct for use in forming a room construction embodying the invention;

Figure 14:
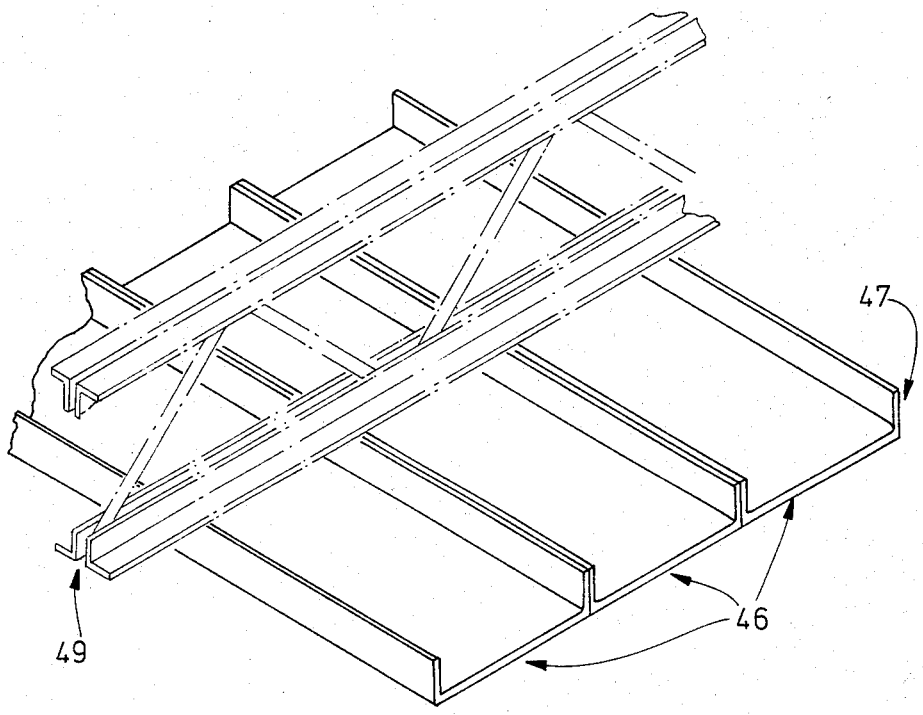
Figure 15A:
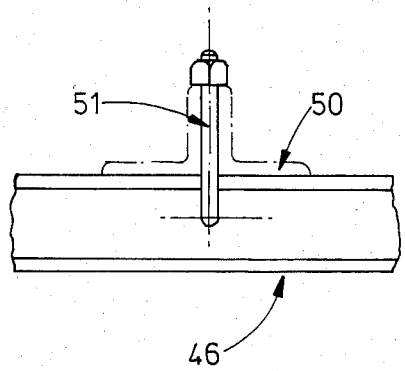
Figure 15B:
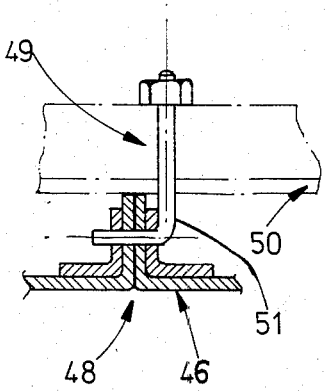
Figure 16:
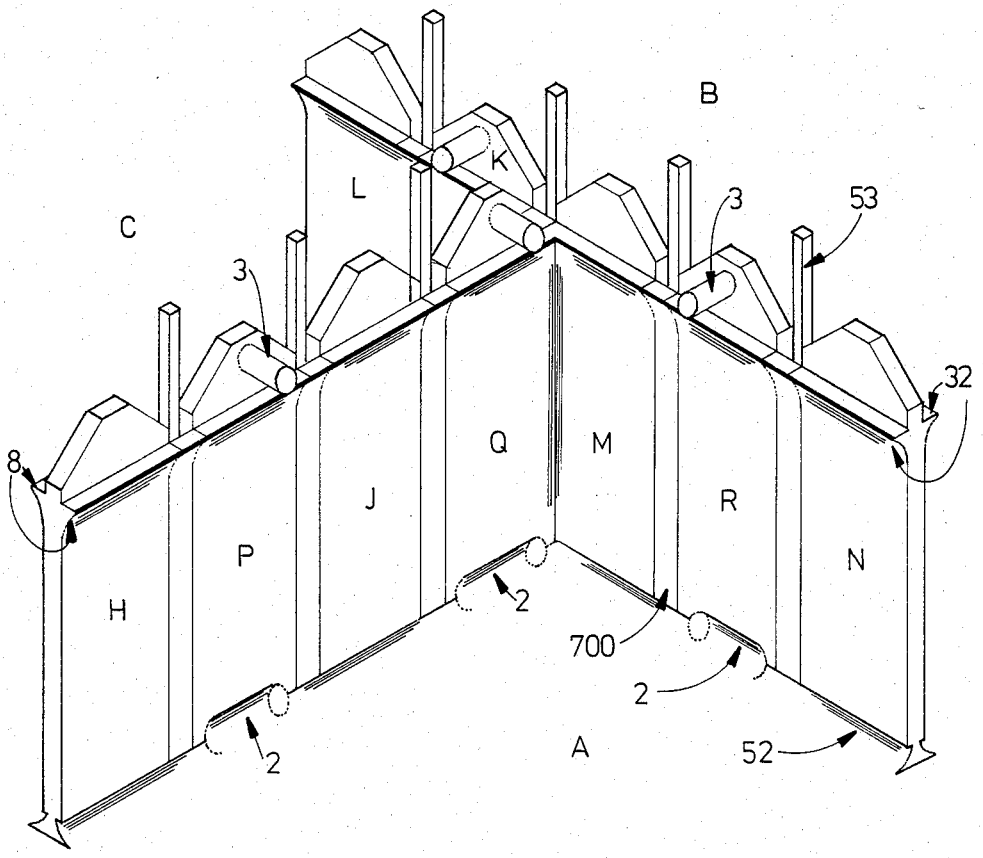
Figure 17:
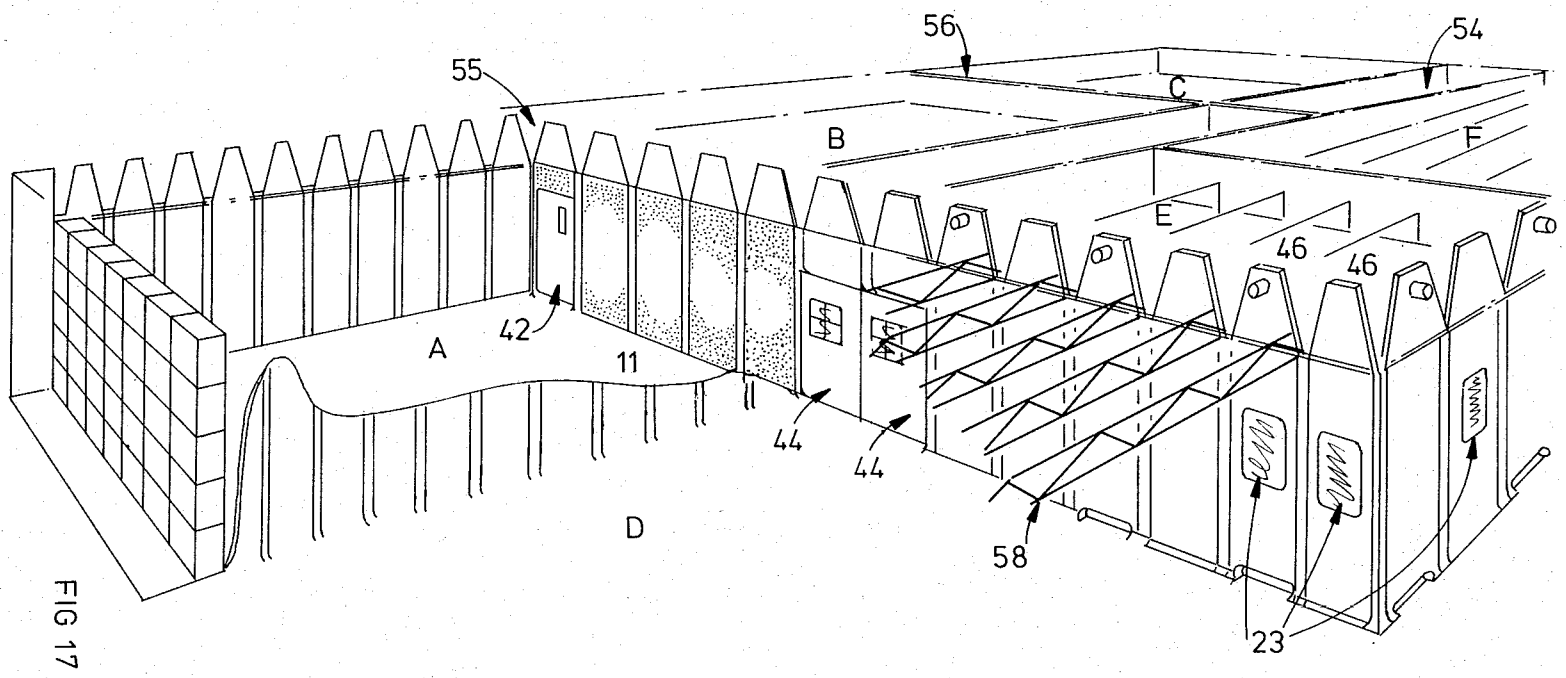
Figure 18A:
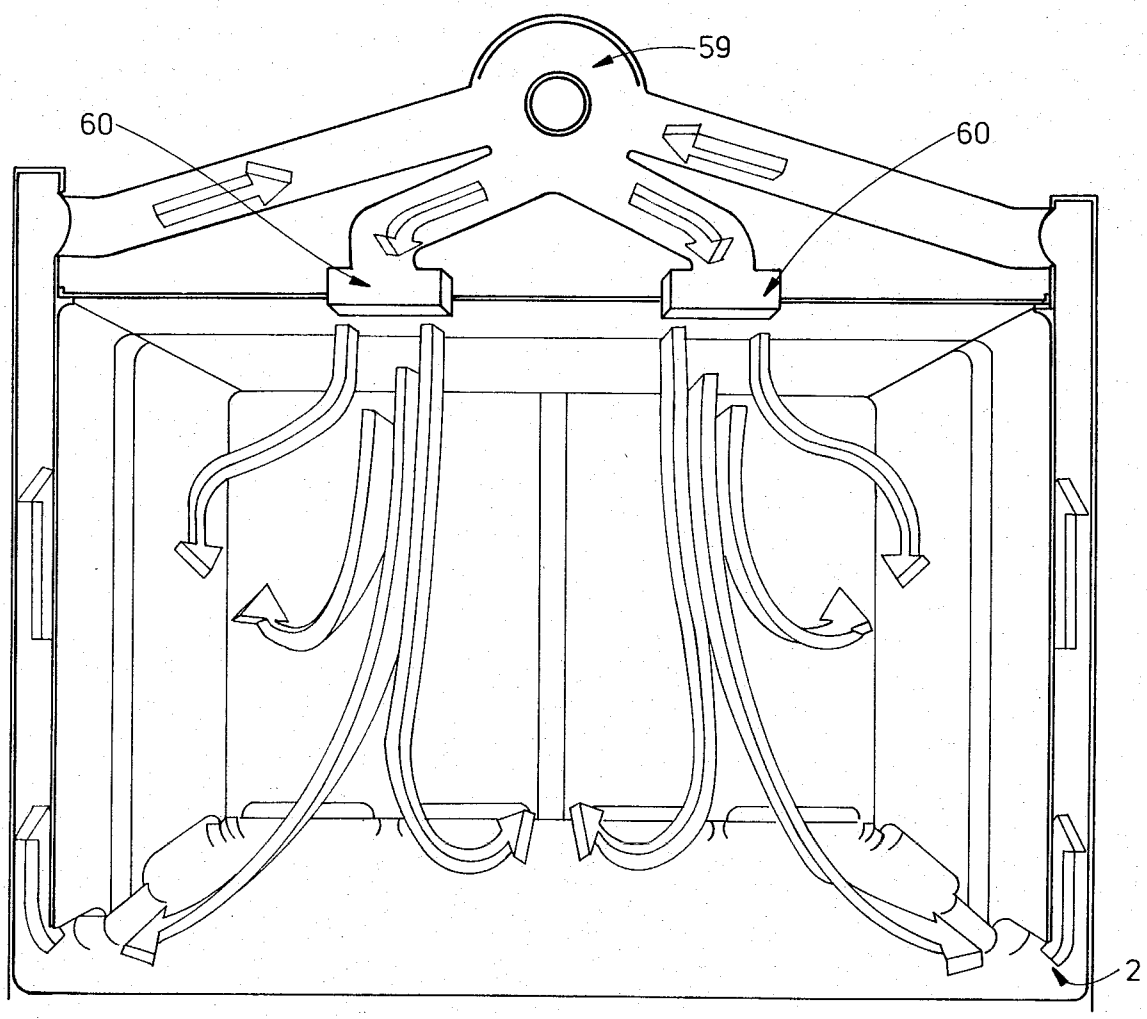
Figure 18B:
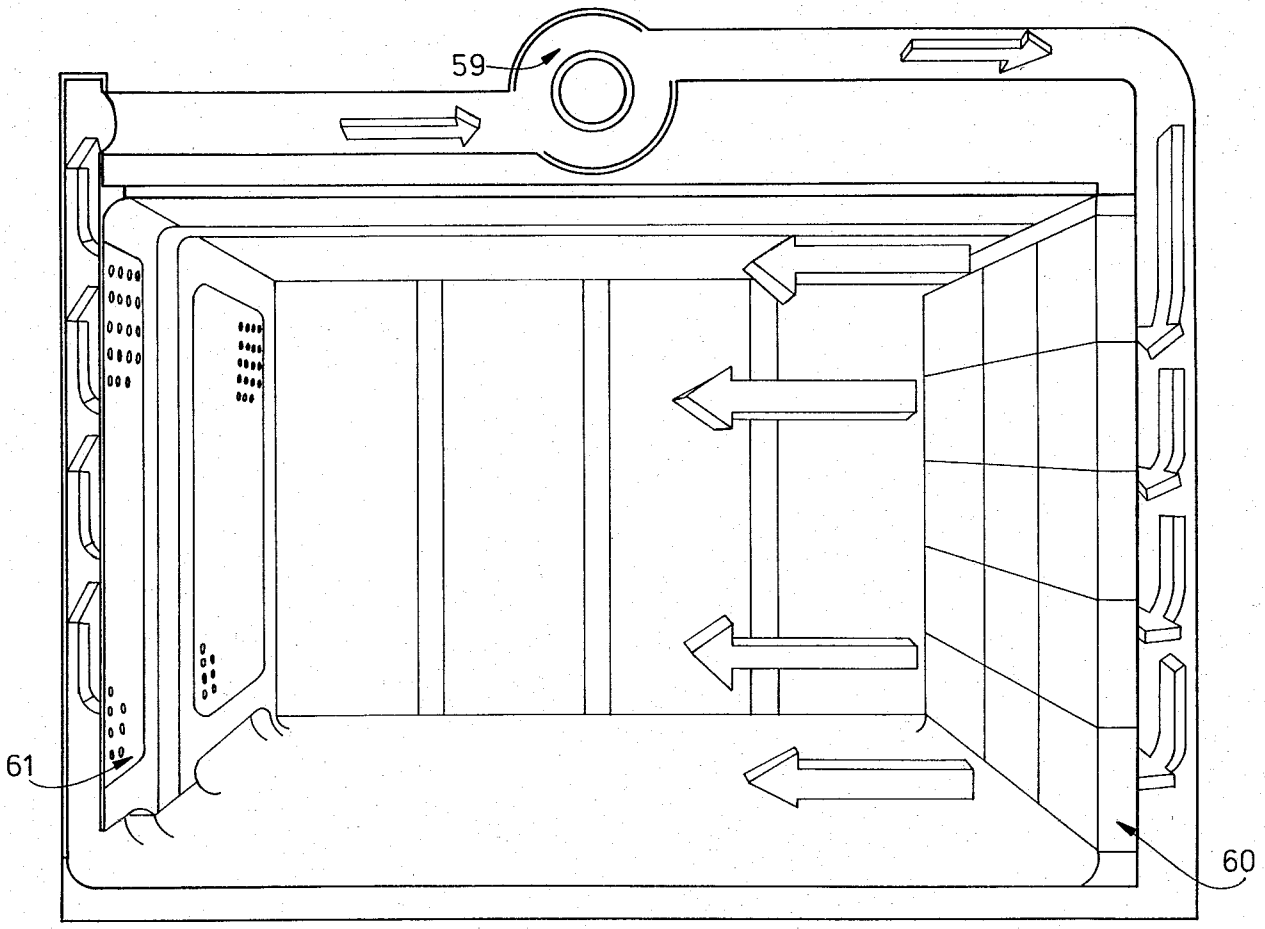
Figure 18C:
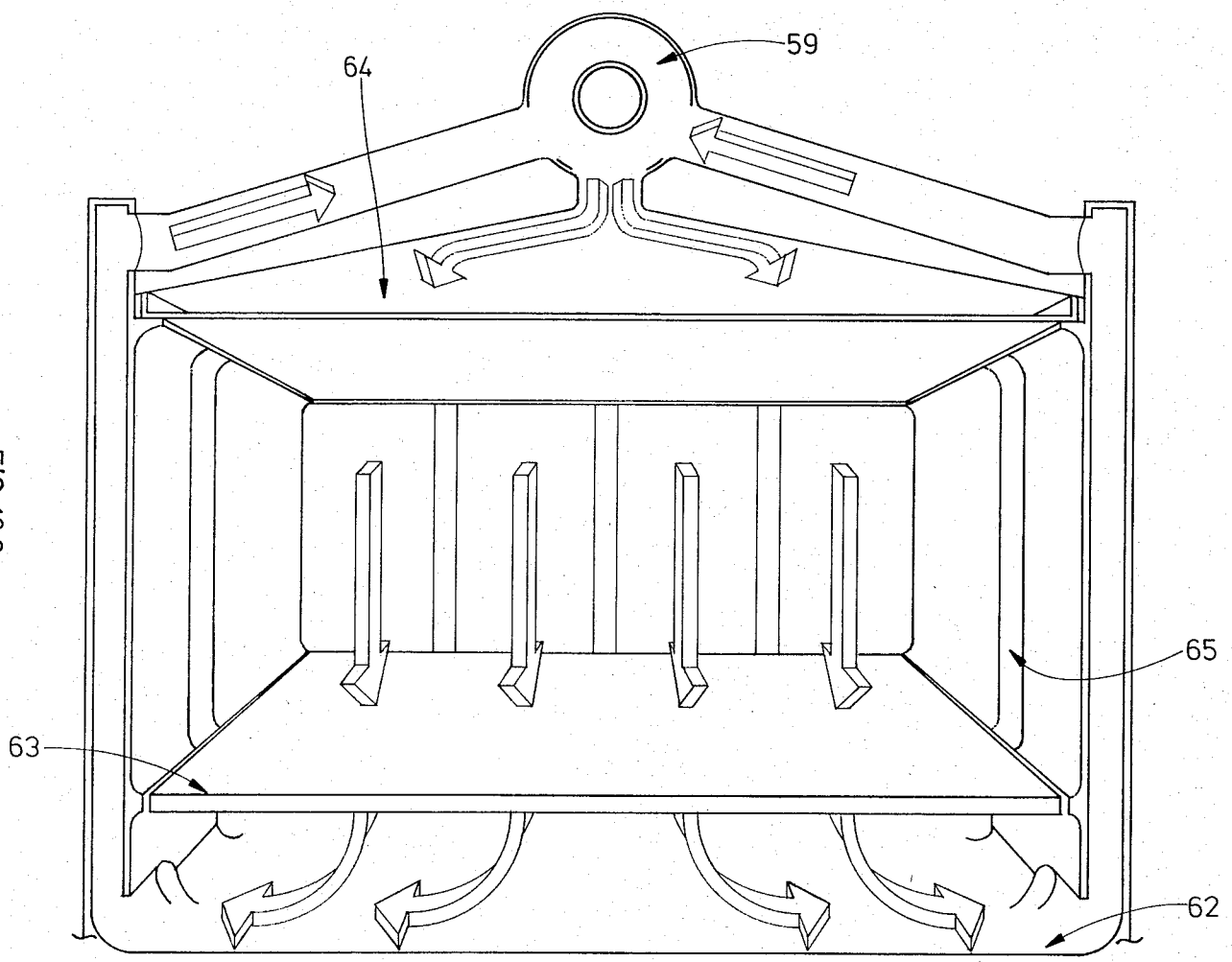

FIGS. 13A, 13B, and FIGS. 13C and 13D show in elevation and transverse cross-section typical door constructions for inclusion in a room construction embodying the invention;

FIG. 14 shows in perspective view from above ceiling elements of the room construction;

FIGS. 15A and 15B are vertical sections at right angles to one another through the ceiling panels at their position of connection to roof girders of a building in which the room construction is set up;

FIG. 16 is a perspective view of a triple room construction embodying the invention in a corner region common to the three rooms;

FIG. 17 is a perspective view of a multi-room construction embodying the invention; and FIGS. 18A, 18B and 18C show schematically respectively conventional air flow, horizontal air flow and vertical air flow achieved in room constructions embodying this invention.

In various of the foregoing figures, vertical sections shown in B figures are taken through the corresponding A figures at A—A.

Figure 1A:
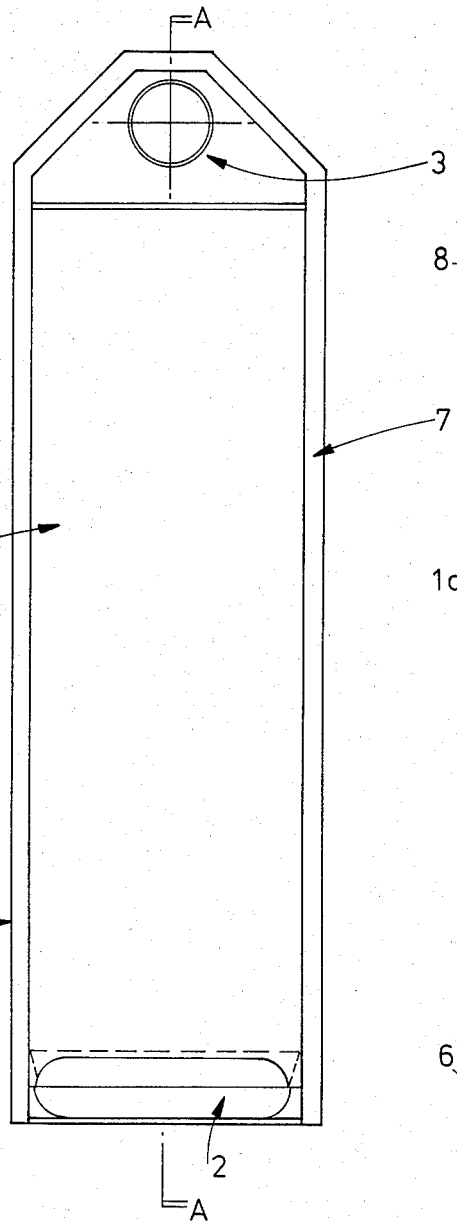
Figure 1B:
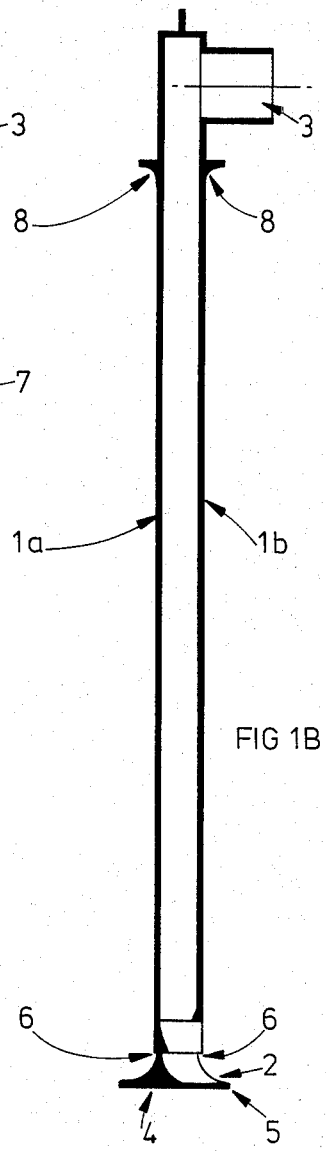
Figure 1C:
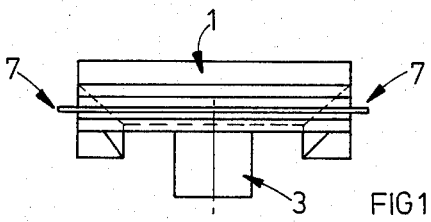

Referring to FIGS. 1A to 1C of the drawings, there is shown what may be termed a basic wall panel 1 for a room construction embodying the invention. In order that a modular system should be built up incorporating such wall panels, all elements of the room construction will have dimensions which are the same, a whole number multiple or a fraction thereof. Thus it is envisaged that the wall panel of FIGS. 1A to 1C will have a width of 1000 mm. The wall panel is of double skin construction and is preferably moulded from glass reinforced polyester which has the advantageous qualities for the aforementioned uses of lightness, strength, durability, chemical resistance and reproducible finish. The panel has opposed skins 1*a* and 1*b* *(see FIG. 1B). The wall panel is a closed element but for the provision of an air duct opening 2 at floor level and an air extract spigot 3 above ceiling level. The main wall surfaces 1a* and 1*b* are coved at their transition to a base 4 of greater width than the thickness of the panel. The coves are stepped at 5 above the base floor to enable a floor screed to finish flush with the horizontal face of the cove allowing sheet, painted or tile floor finishes to be accommodated. The walls are stepped forward from the vertical face of the cove at 6 to allow a flooring material such as sheet, trowelled or painted flooring to be applied continuously up the curved surfaces to the wall step to finish flush with the wall face of the panel. Lugs 7 (see FIGS. 1A and 1C) are formed integrally with the side skins of the panel to provide means for the fixing of the panels to support posts or to adjacent panels as will be described hereinafter. Coves 8 are moulded at ceiling level into the main skins of the panels to provide a smooth transition from wall to ceiling. The wall panel extraction air outlet spigot 3 is moulded into one main panel skin (the choice is immaterial) above ceiling level.

Figure 2A:
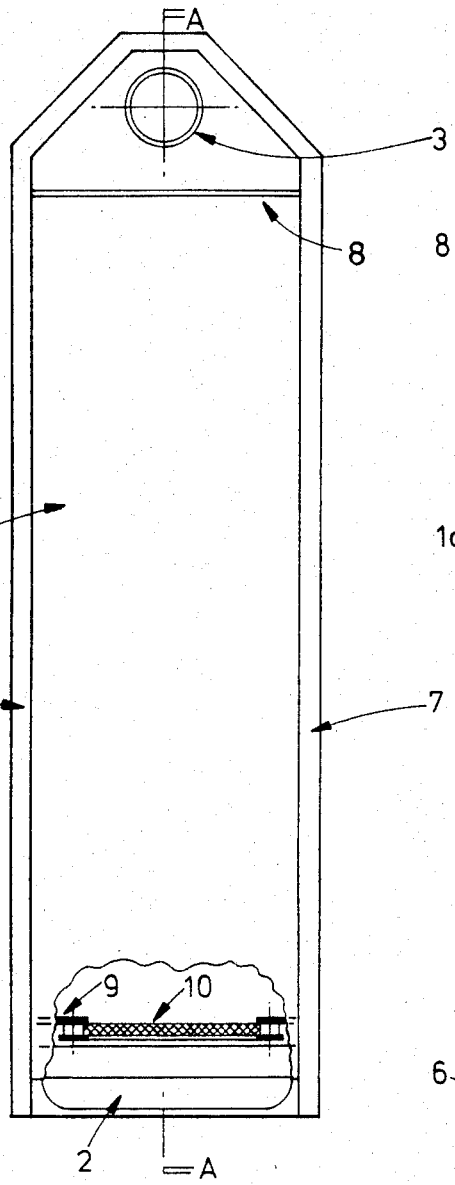
FIGS. 2A and 2B are an elevation with parts cut away and a vertical cross section through a modification of the panel of FIG. 1, provided with a security filter.
Figure 2B:
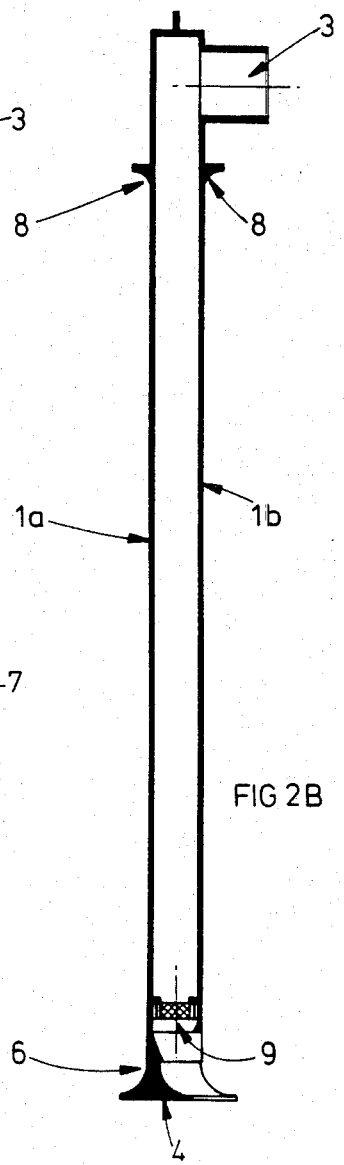

Referring to FIGS. 2A and 2B in which like reference numerals represent like parts in FIGS. 1A to 1C, a panel of fundamentally like construction to that shown in FIGS. 1A to 1C incorporates in addition in the interior thereof just above the wall panel air duct inlet 2 a filter frame 9 carrying a security filter 10. The filter is accessed for renewal via the air duct opening 2 and is held and sealed against the filter frame mechanically (not shown).

Figure 3A:
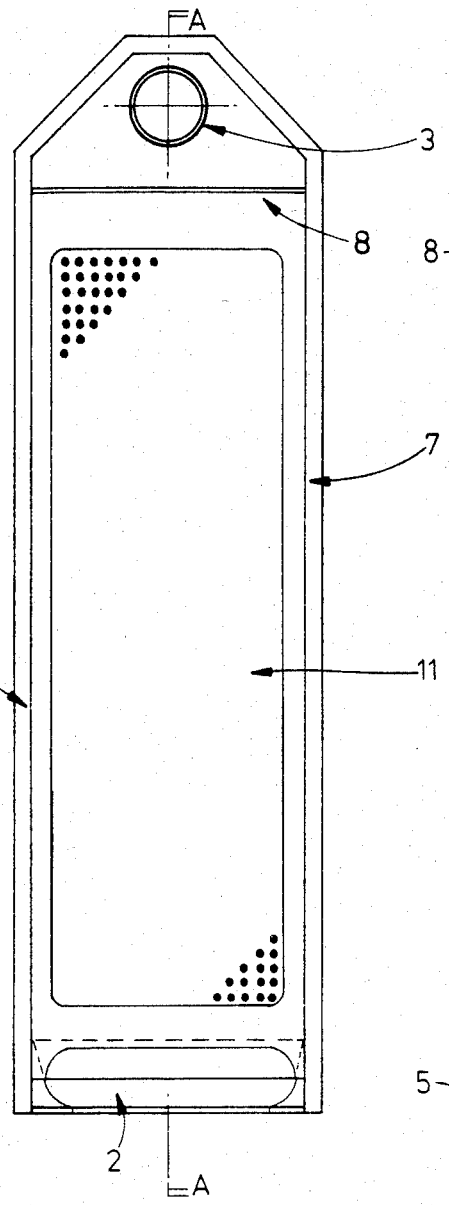
FIGS. 3A and 3B are an elevation of and a vertical cross-section through a third form of panel having provision for horizontal unidirectional air flow extraction.
Figure 3B:
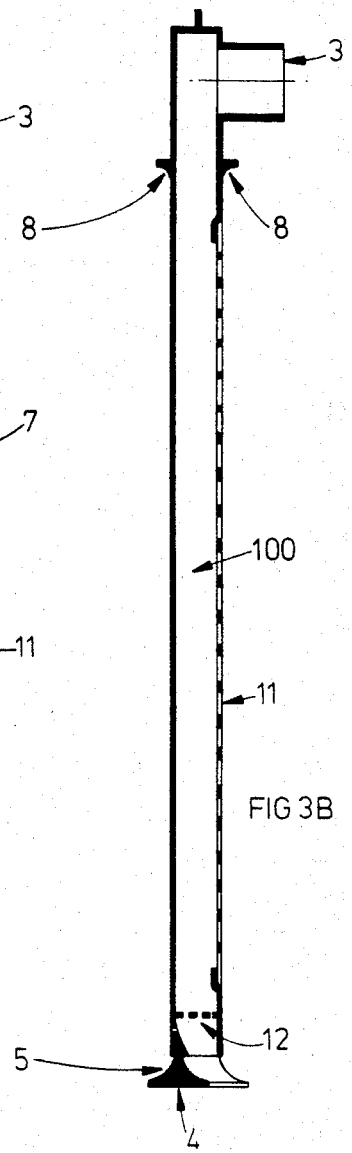

Referring next to FIGS. 3A and 3B in which again like reference numerals represent like parts in FIGS. 1A to 1C, a wall panel 100 for use in a room construction embodying the invention but which is to be employed in a unidirectional horizontal air flow system through the room comprises one main skin 11 which is formed with a plurality of perforations over its surface area. These perforations may also be included in a skin 12 which lies across the air intake duct inlet 2. With such a construction, air can be drawn from the room into the wall panel duct evenly over the whole face of the perforated skin. As an alternative to forming the perforated skin integral with the remainder of the panel, it may be convenient for the panel to be formed without such skin and for a separately formed element to be connected as a second main skin to the remainder of the panel by adhesive bonding or the like.

Figure 4A:
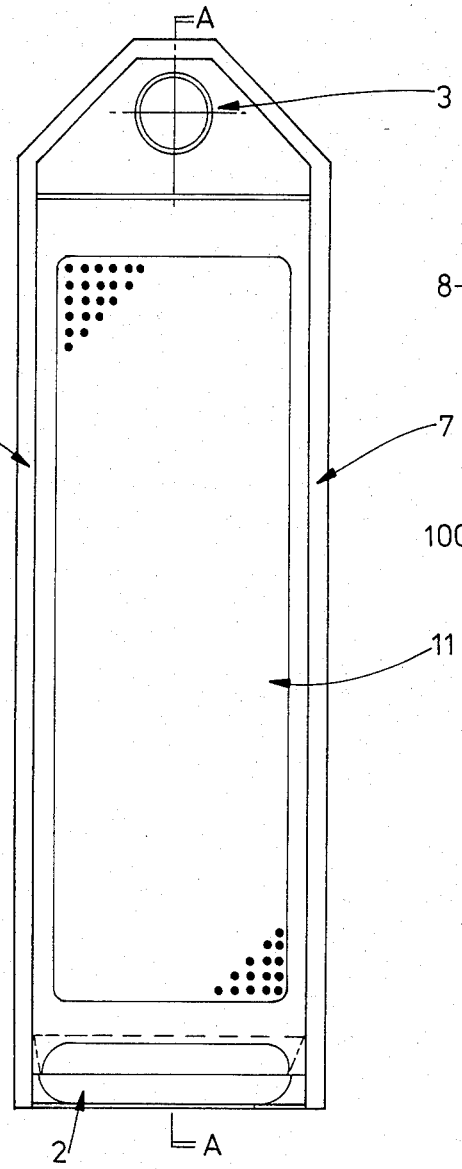
FIGS. 4A, 4B and 4C are respectively an elevation, a vertical cross-section through and a plan view of a panel of the type shown in FIGS. 3A and 3B incorporating additionally a security filter.
Figure 4B:
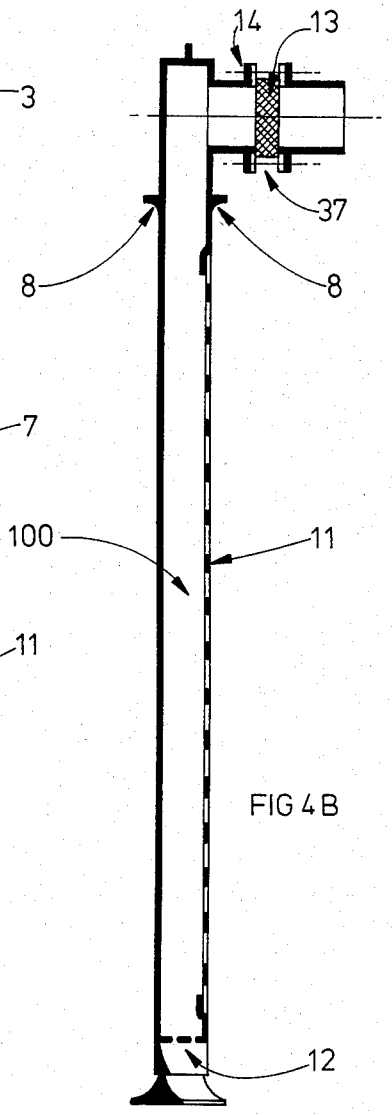
Figure 4C:
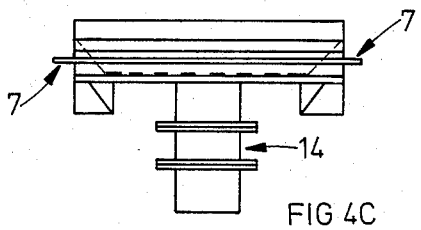

FIGS. 4A and 4B show an alternative position for accommodating a security filter to that shown in FIGS. 2A and 2B, the security filter here being an element 13 provided on flange element 14 attached to the air extract spigot 3 above ceiling level. Such a position of air security filter is applicable to the panel constructions of FIGS. 1A to 1C and 3A and 3B and is of particular value with the panel construction of FIGS. 3A and 3B because of the provision of the perforated skin section 13 at the position of the security filter of FIG. 2.

It is not essential for all of the standard size wall panels of the room construction embodying the invention to include provision for air circulation therethrough. Thus referring to FIG. 5, there is shown a wall panel 200 which apart from the absence of an air extraction spigot is dimensioned overall similarly to a panel of the preceding figures. However an air intake duct is absent from a lower region so that an opposed pair of completely coved base portions 15 is provided. To provide a measure of heat insulation, for temperature controlled rooms and other specific applications, the interior of the panel is filled or lined with suitable insulation material.

Figures 6A, 6B, 6C, 6D:
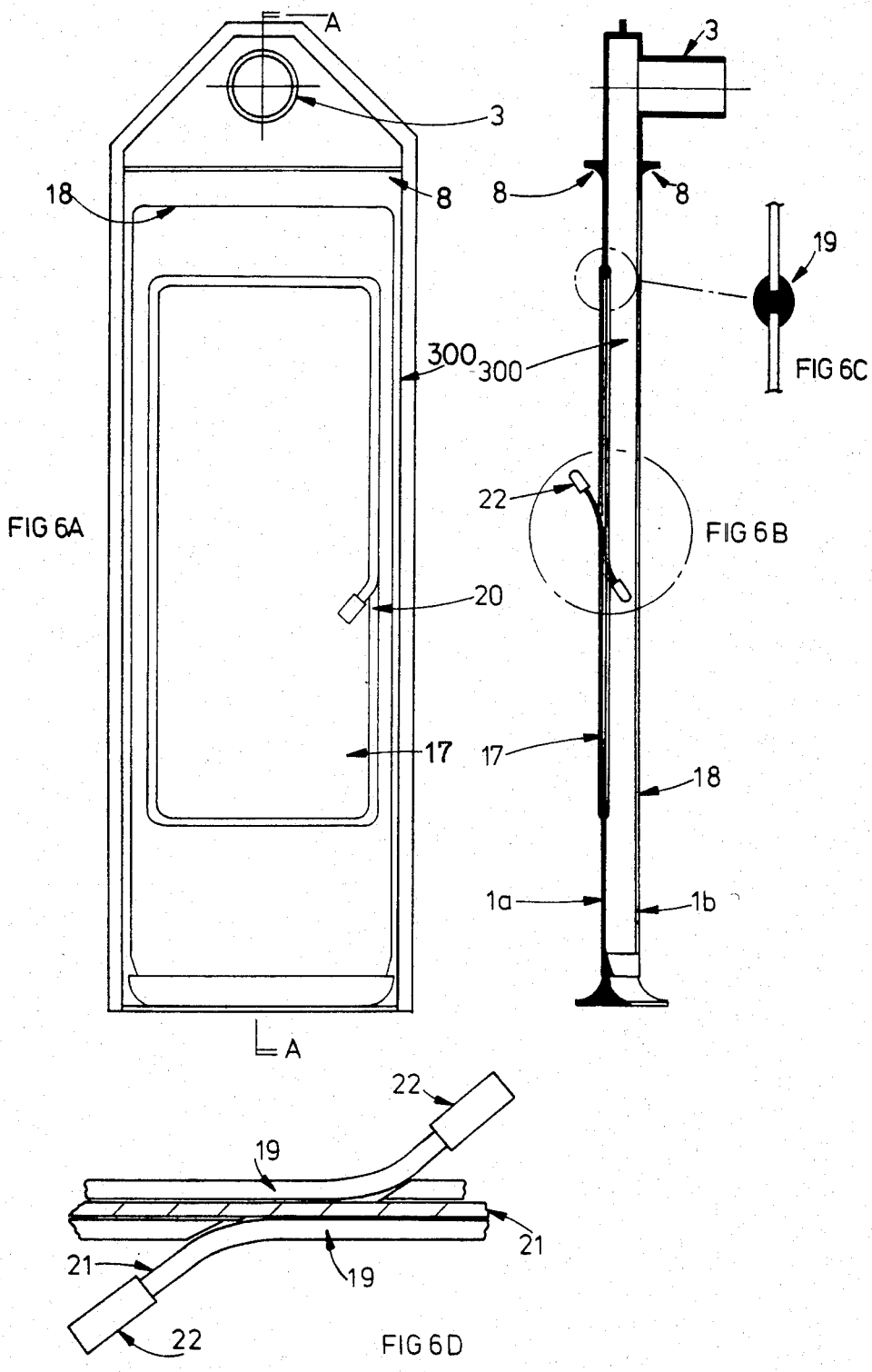
FIGS. 6A and 6B are respectively an elevation of and a vertical cross-section through a wall panel embodying the invention incorporating am emergency exit from the room of which the panel forms a wall part and FIGS. 6C and 6D are details to a larger scale of features shown in FIG. 6B.

In order to comply with statutory regulations concerning fire and for other hazards personal escape routes using emergency exits within such rooms are required. FIGS. 6A and 6B show a personal emergency exit "knock out" panel 17 built into one of the wall panel skins 1*a* of a panel 300. The other wall panel skin 1*b* incorporates a cutaway section 18 to provide clear access once the knock out panel has been removed. The emergency exit "knock out" panel is held and sealed into the wall panel skin 1*a* with a rubber gromet 19 (FIG. 6C). The rubber gromet overlaps the joint seal on each side of the panel at a handle position 20 (FIG. 6A) so creating a tab handle 21 on one or either side of the "knock out" panel 17 (see the enlarged scale view 56 table handle 21 in FIG. 6D) on which a handle 22 is affixed. Access through the panel can be achieved in an emergency. from either side by pulling the tab handle 21 on the appropriate side so stripping the gromet from the wall panel and "knock out" panel 17 thereby allowing the emergency exit panel to be pushed out. The provision of the tab handles on both sides and the provision of see-through windows of which the panel 17 may be one make it possible for either the person working in the room to escape or for rescuing personnel to reach him.

Figure 7A:
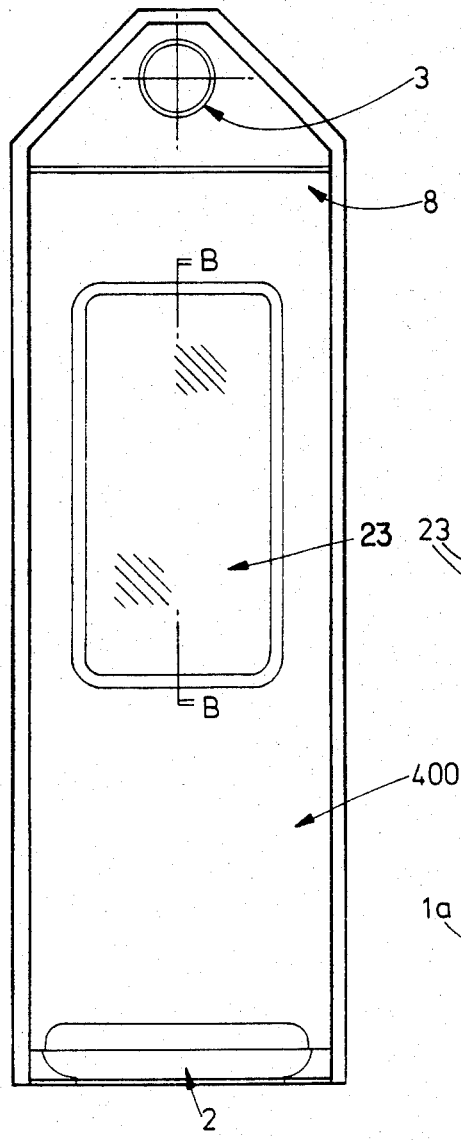
FIG. 7A is an elevation of a panel incorporating a viewing window and FIG. 7B shows in vertical cross-section, the viewing window.
Figure 7B:
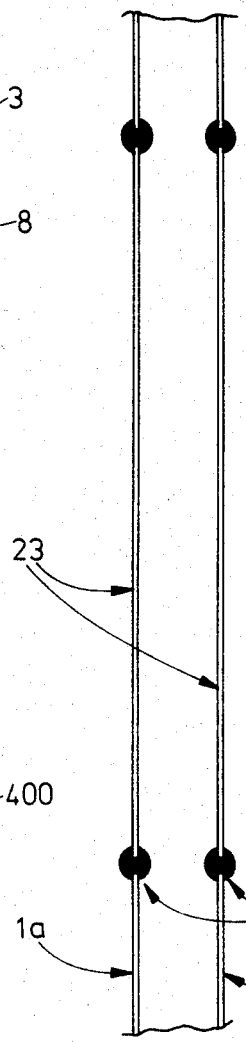
Figure 8A:
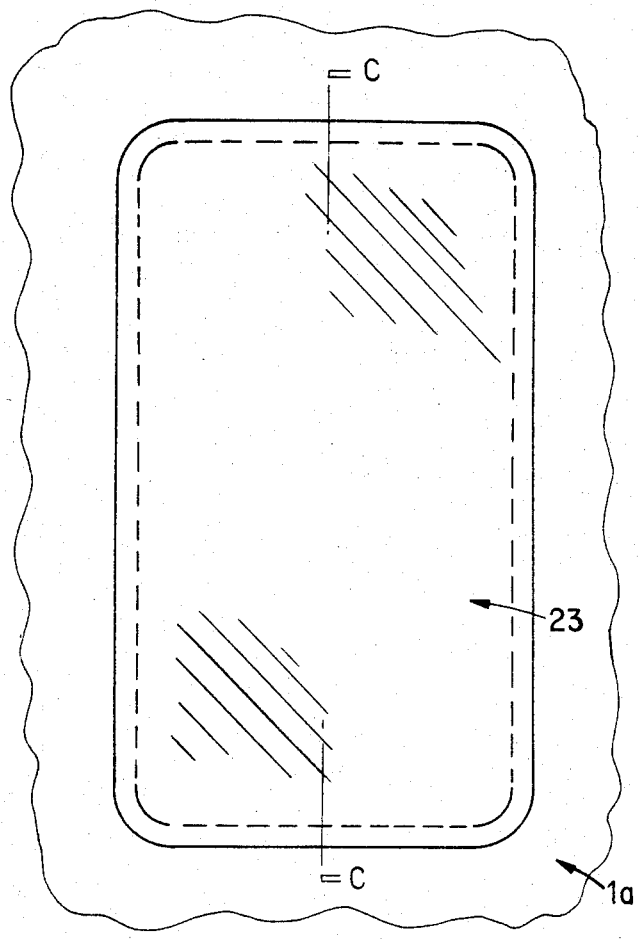
FIGS. 8A and 8B are respectively an elevation of and a vertical cross-section through an alternative form of window construction to that shown in FIG. 7B.
Figure 8B:
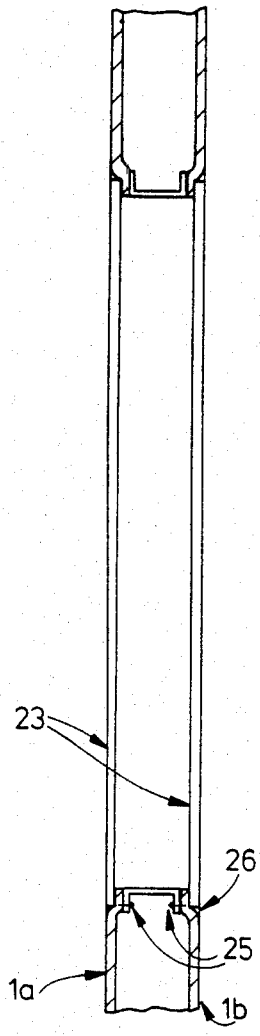

A viewing facility into the room can be provided in ways additional to those envisaged in connection with FIG. 6A. For example a conventional panel, that is having air flow therethrough may nevertheless have a viewing window to enable occupants outside a room to view activities in the room. Thus referring to FIG. 7A, a panel 400 of like format to that shown in FIGS. 1A to 1C has additionally a glazed portion 23 in each of the main skins in direct line across the panel cavity. Referring specifically to FIG. 7B which is a section through FIG. 7A at B—B, the glazed panels 23 can be seen to be held into the wall panel with rubber gromets 24. As an alternative to this holding arrangement, in FIG. 8A and FIG. 8B (a section through FIG. 8A at C—C, glazing panels 23 are held in rebates 25 moulded into each of the panel skins by means of adhesive 26 applied to the rebates.

As previously indicated, the integral lugs 7 on all wall panels of a room construction embodying the invention play a part in enabling a room construction to be formed utilising the wall panels. Thus referring to FIG. 9, a vertical internal corner piece 500 enables two wall panels at right angles to each other to be connected and at the same time provides a smooth transition around the corner both at floor and wall level. The corner piece 500 comprises two main walls 27 and 28 at right angles to each other which nestle into the right angle formed between the lugs 7 and the wall skins of the panels from which they project. The corner piece has a similar profile to the wall skins for which it is to provide a continuous surface, including concave rounding in the region where the walls 27 and 28 come together (coving 29) and coving 30 in a base region for providing the aforementioned smooth transition both from wall to wall and from wall to floor. Integrally mouled with the corner piece in an upper region thereof are sections of corner cove 31. The corner piece is bonded and sealed to the wall units.

Figure 9:
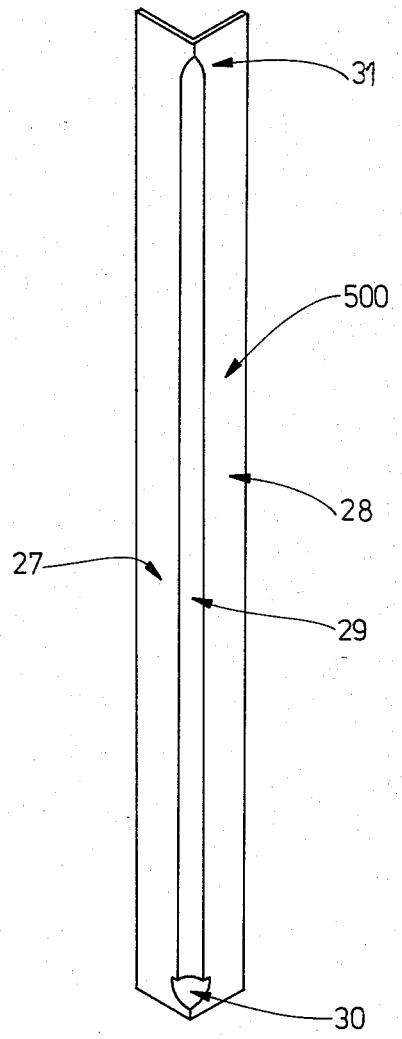
FIGS. 9 and 10 are perspective views of alternative forms of corner panels which enable between them most forms of room shape to be accommodated.
Figure 10:
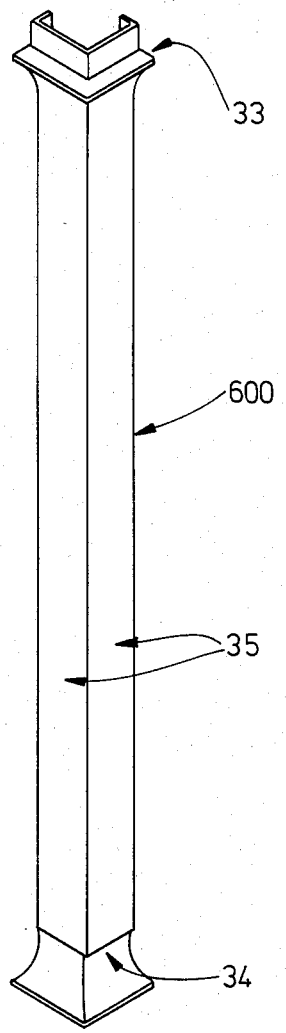
Figure 11A:
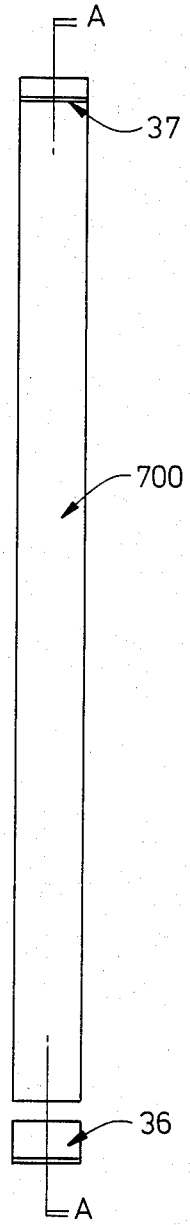
FIGS. 11A and 11B are respectively an elevation of and a vertical cross-section through a services panel which links one mainpanel face to another.
Figure 11B:
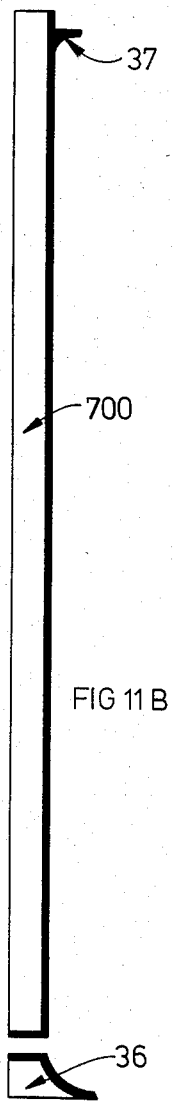

The corner unit of FIG. 9 provides a neat finish within a room. If a corner position is common to two or more rooms then an appropriate number of corner pieces 500 will be employed, one corner piece being employed between each two wall skins at right angles to each other. Where wall skins are external to a plurality of room constructions embodying the invention, then two types of filler elements are proposed for providing a neat appearance on the exterior of the room assembly. Thus FIG. 10 shows an external corner piece which is to be employed where only two wall panels embodying the invention come together and are given a smooth connection within the room by a corner piece 500 of FIG. 9. The corner piece 600 of FIG. 10 maintains an identical profile to the wall panels and utilises the lugs 7 on the sides of the wall panel for its location. A cove 33 is moulded into an upper region of the panel to be continuous with coving 8 on the outside of the exterior skin 1*a* of the wall panel and coving 34 is provided around the two sides 35 of the corner piece. The corner piece is bonded and sealed into the wall panel unit.

Where there is a T-junction between walls of adjacent rooms, then use will be made of two corner sections of the type shown in FIG. 9 within the room and a flat service panel 700, generally 200 mm wide as shown in FIGS. 11A and 11B. This maintains the basic profile of the panels, although extending up to ceiling level only, and includes a coved portion 36 at the base thereof and a cove 37 which are intended to be continuous with coves of adjacent wall panels. These service panels can also be employed to box in support posts (see FIG. 16) to be positioned between panels assembled in a straight line. The service panels 700 are fixed in place with simple mechanical locators and subsequently the joint is sealed.

Service supplies to the room can be fed behind the service panels to terminate within the rooms for onward connection to equipment used within the rooms. The service panels are split at the base 36 so that the main part 700 may be removed conveniently during the life of the room to allow additional services to be installed as required.

Figure 12:
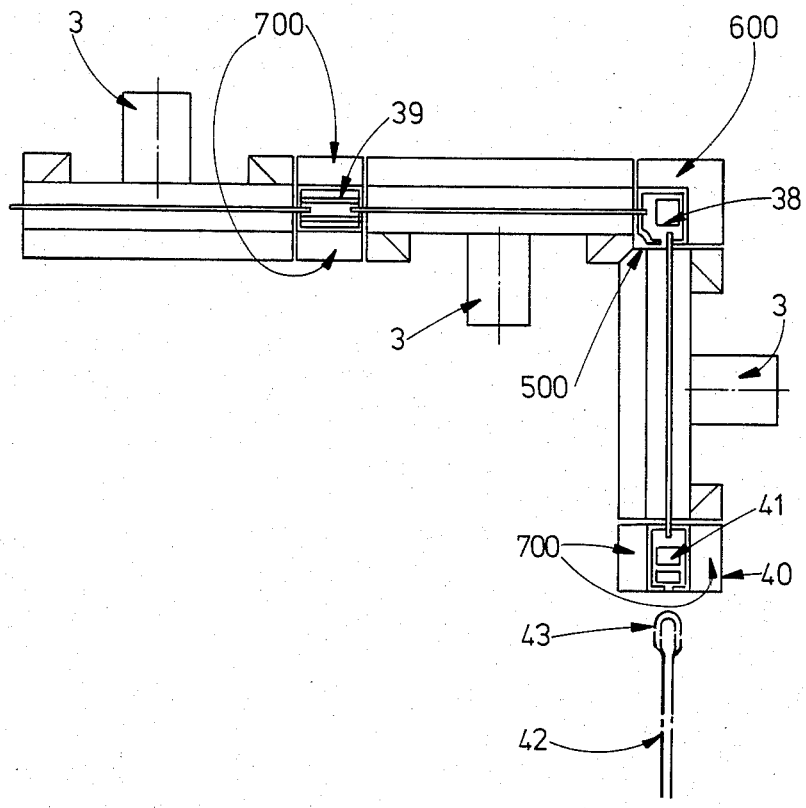
FIG. 12 is a plan view of a corner region of a room construction embodying the invention and showing standard dimensioned wall panels used in the room construction.

Referring next to FIG. 12 there is shown in plan view a typical assembly of panels embodying the invention, together with appropriate corner pieces and service panels. The panels shown can be of the type shown in FIG. 1 and there are shown in combination corner pieces 500 and 600 of FIGS. 9 and 10 respectively with additional support being provided by a corner post 38 to which the lugs 7 of the panels are bolted. Service panels 700 of FIG. 11 are shown at two positions. Firstly they are shown at a position at which adjacent panels are connected together at upstanding slotted members 39 into the slots of which the lugs 7 of the panels engage. These fixing elements are an alternative to the fixing posts to be described hereinafter with reference to FIG. 15. The alternative use of the service panels 700 is in the formation of a door jamb 40 (see hereinafter with reference to FIGS. 13A to 13 D).

FIG. 12 is also useful in showing how a single wall formed of panels embodying the invention may be used in the extraction of air from adjacent rooms. This is made possible merely by the alternate handing of panels in a run thereof.

Figure 5A:
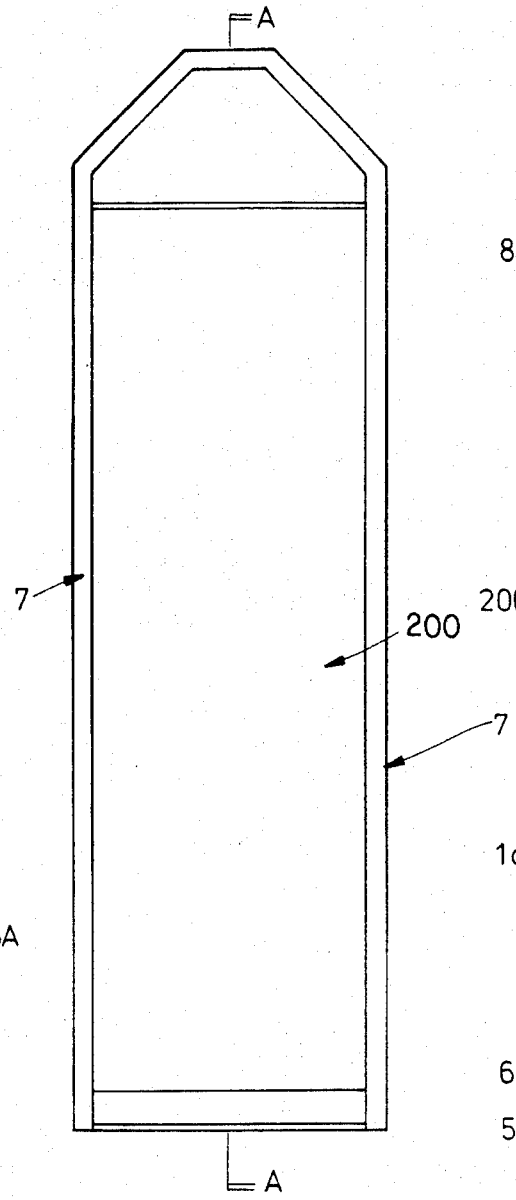
FIGS. 5A, 5B and 5C are respectively an elevation, a vertical cross-section through and a plan view of a blank wall panel which can optionally include piped and cable services.
Figure 5B:
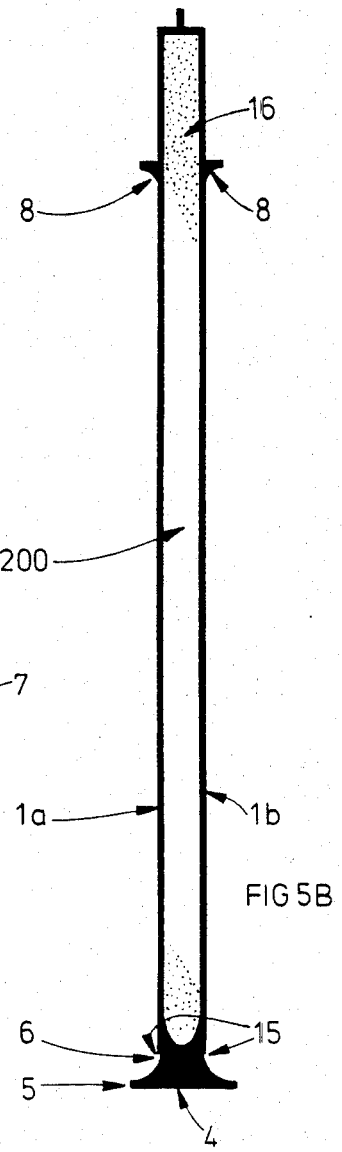
Figure 5C:
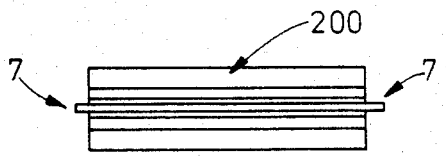
Figure 13A:
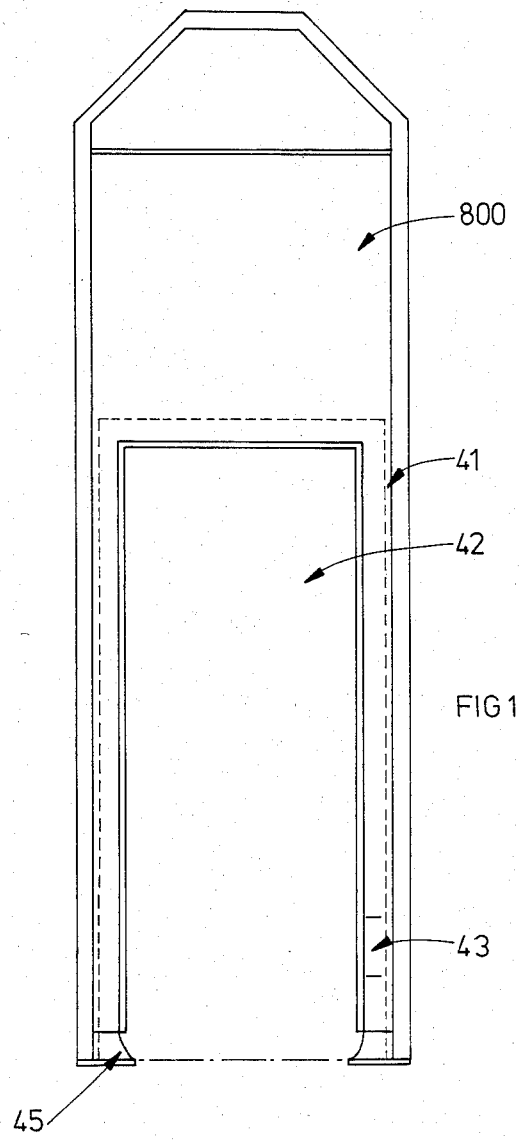
Figure 13B:
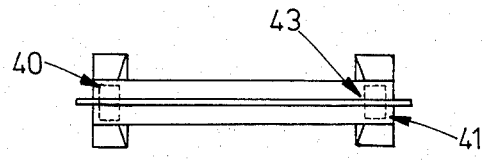

Referring next to FIGS. 13A and 13B, a single door 42 is shown to be incorporated into a main panel 800, typically a panel of the type shown in FIG. 5.

A subframe 41 is incorporated inside the panel 800 allowing the door hinges 43 to be secured through the panel door jamb. Most door and hinge types can be accommodated (including rebated door jambs) in this manner. The base of the door jamb is coved at 45 in a similar fashion to the coving 5 of the main panel 800.

Figure 13C:
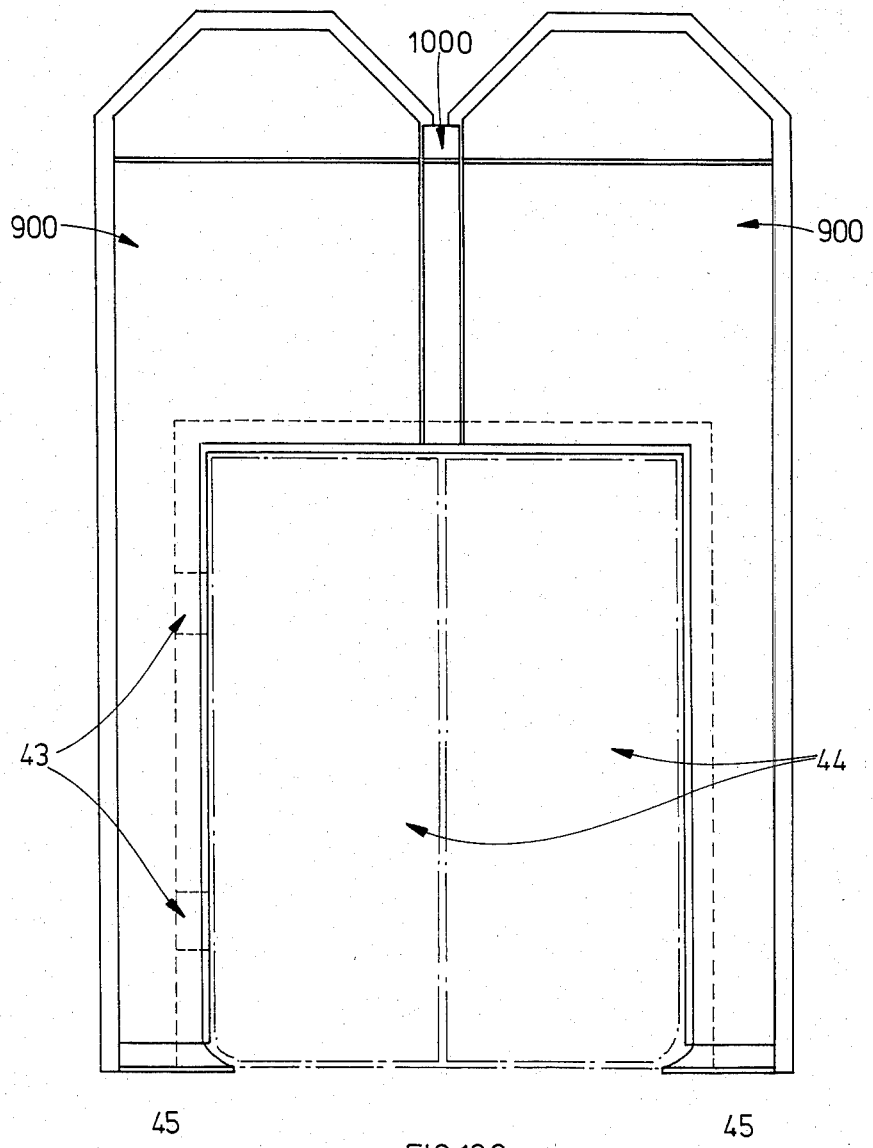
Figure 13D:
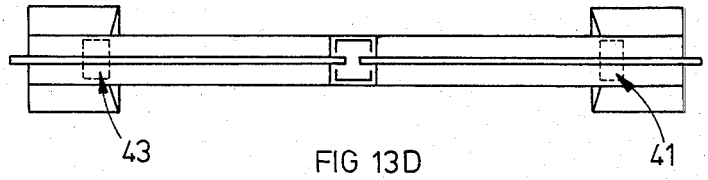

FIGS. 13C and 13D illustrate how a double door arrangement is accommodated by the combination of two modified main panels 900 and a shortened service panel 1000. Analogous constructional features to those shown associated with door 42, in particular, hinges 43 and subframe 41 (see FIG. 13A) are incorporated in the double door of FIGS. 13C and D.

Referring to FIG. 14, a ceiling construction for rooms constructed according to the invention may be made up from a plurality of ceiling units 46 having for example the standard module dimension of 1200 mm of the panels and extending wall to wall. The panels 46 are channel shaped in cross-section, having flanges 47 providing surfaces for connecting one panel to another with mechanical fixings, adhesive or sealant 48 (FIG. 15B). As can be seen particularly well from FIGS. 15A and 15B, the flanges 47 also act as brackets for the support of the ceiling below a permanent feature of the building in which the room construction is formed. For example roofing girders 49 of the type shown in FIG. 14 may be formed with flanges 50 through bores in which pass hook bolts 51 entering appropriate openings in the flanges 47 of the panels. At wall junctions, the ceiling panels are bonded and sealed to the ceiling coves. Light fittings and filter housings may be fitted to and bonded into the ceiling panels 46 in appropriate manner (not shown).

A fuller overall appreciation of the manner in which multiple room structures can be built up embodying the invention from panels as aforesaid will be best appreciated by reference to FIGS. 16 and 17 in which like reference numerals denote like parts in the preceding Figures.

For the purposes of simplicity, it may be assumed in FIG. 16 that the wall panels given the letters H to R are all of the type shown in FIGS. 1A to 1C, the panels being supported on posts 53 clad in service panels 700. Each panel is provided with a floor level air duct opening 2 with adjacent panels being oppositely handed so that overall provision is made along the length of one wall for air to be extracted therethrough from the two rooms which it separates. A proprietory floor finish such as vinyl sheeting 52 lies on the floor above screeding and enters into and around the openings to the openings 2. Depicted in FIG. 16 are three rooms A, B and C divided by the walls made up of panels H to R. Air is extracted from room A via floor level openings 2 to respective outlet ducts at spigots 3 from which it is connected into the main heating and ventilating or air conditioning duct work. Ducts in panels P, Q and R serve room A. Air from room B is extracted in independent duct panels L, M and N and air from room C is extracted in independent duct panels H, J and K. In the interests of clarity the ceiling panels are not shown, although the ceiling coves 32 are shown.

FIG. 17 shows a multi-room construction in which wall panels as aforesaid are employed to construct six rooms A to F arranged with rooms A to C on one side of a corridor 54 and the rooms D to F on the other side. The corridor is divided up by double doors, 44 of the type shown in FIGS. 13C and 13D at the position of room dividing walls 55 and 56. A door 42 of standard unit width communicates rooms A and B. Room A is shown to have provision for unidirectional horizontal air flow therewithin, incorporating panels of the type shown in FIGS. 3A and 3B. Room E shows the arrangement of ceiling panels 46 and a roof girder construction 58 can be seen to be extending above ceiling level through room D. Viewing windows 23 are shown in some of the wall panels of room E.

Referring finally to FIGS. 18A, 18B and 18C, the diagrammatic air flow through rooms constructed according to the invention can be seen. In each case a fan 59 is shown. This will not normally be placed above the room but at a central position to which extend duct work from individual panels and rooms and from which extends duct work back to the rooms. Filters 60 are provided at ceiling level (FIG. 18A or FIG. 18C) or as a wall (FIG. 18B). Arrows denote the direction of air flow in each case. In FIG. 18A air flow is through ceiling mounted filters 60 into the room and out thereof through air duct openings 2 at floor level, up through the wall panels and back to the fan 59. In FIG. 18B, opposite walls 60 and 61 are provided for horizontal air flow therethrough. Entry walls 60 are filter banks. Finally in FIG. 18C, above the base floor 62 of the room is provided an intermediate grill floor 63 formed with small openings (not shown). This is the operative floor of the room above which all normal activity will take place. Air enters the room through a filter bank 64 occupying the entire ceiling area, but passes vertically downwards through an intermediate floor grill to a sub-floor space from which it is drawn into the interior of the panels through air duct openings 2. The smooth floor to wall transition of FIGS. 1 and 2 maintained by the provision of coving between the upstanding wall surfaces 65 and the grill 63.

From the foregoing, it will be apparent that room constructions can be provided embodying the invention which may be of the sealed pressure type with smooth, crevice and ledge-free room surfaces. The room construction is primarily intended to serve the needs of industries, research and medicine where cleanliness and/or sterility or an intrinsic requirement for the operations to be performed within the rooms. The room constructions embodying the invention are nevertheless also suitable for use as temporary or semi-permanent rooms within buildings which may be employed where a high density of people is anticipated, such as theatre foyers, lecture theatres, conference rooms, dance halls, discotheques, where the ready provision of air flow ducting arrangement without the need for unsightly ducts to be visible can be provided quickly and relatively inexpensively.

We claim:

1. In a room construction for maintaining a sterile environment comprising a plurality of ceiling panels, a plurality of wall panels having a double wall construction with an air space existing between opposite walls thereof, and means connecting the wall panels together at upstanding marginal regions thereof, the wall panels including thereamong a plurality of panels each having in a lower region thereof at least one aperture thereinto from the room interior communicating the room interior with the interior of the panels and means in an upper regions thereof for communicating the interiors of the respective panels with extraction ducts, the wall panels being coved at their base edges to provide a rounded surface transition from wall to floor within the room, the improvement comprising including as said wall panels, wall panels moulded as a single element from synthetic plastics material in a double skin construction with opposite walls joined at their upstanding edges and forming said wall panel connecting means at connections between in-line panels as single walled moulded panels of synthetic plastics material having coving at their base edges connected to the said wall panels on either side thereof to provide a surface continuous with that of the panels which they join at substantially all positions over the height thereof at least up to ceiling level and to provide therebehind service ducts for supply of services to the exterior of the wall comprised thereby.

2. The room construction of claim 1, wherein said panels are in association with one or more corner pieces for joining adjacent panels of double wall construction at corner positions and shaped to provide a surface continuous with the panels which are thereby joined at substantially all positions over the height thereof at least up to ceiling level.

3. The room construction according to claim 2, wherein all said panels and said corner pieces are formed of glass reinforced plastics material.

4. The room construction of claim 1, wherein all said panels are stepped at their coves above the room floor to enable a floor screed to finish flush with the horizontal face of the cover and are stepped forward from the vertical faces of the cove to allow a flooring system to be applied continuously up the coved surfaces to end flush with the wall surface of the panels.

5. The room construction claimed in claim 1, wherein at least one of said panels having a double wall construction have one wall formed with a plurality of apertures disposed thereover from said lower region upwards for enabling horizontal air flow into the panels to take place across the room construction.

6. The room construction according to claim 1, wherein all said panels are formed at ceiling level thereon with an integral coving extending thereacross on which ceiling tiles rest.

7. The room construction according to claim 2, wherein said corner pieces and all said panels are stepped at their coves above the base floor to enable a floor screed to finish flush with the horizontal face of the cove and are stepped forward from the vertical faces of the cove to allow a flooring system to be applied continuously up the coved surfaces to end flush with the wall surface of the panels.

8. The room construction according to claim 1 wherein all said panels are formed of glass reinforced plastics material.

9. The room construction claimed in claim 5, wherein all said panels are formed of glass reinforced plastics material.

10. The room construction according to claim 1 and which additionally includes at one or more panel positions a door.

11. A room construction for maintaining a sterile environment comprising a floor construction, a plurality of ceiling panels a plurality of wall panels having a double wall construction with an air space existing between opposite walls thereof, and means connecting the wall panels together at upstanding marginal regions thereof, the wall panels including thereamong a plurality of panels each having in a lower region thereof at least one aperture thereinto from the room interior communicating the room interior with the interior of the panels and means in an upper region thereof for communicating the interiors of the respective panels with extraction ducts, the wall panels being coved at their base edges to provide a rounded surface transition from wall to floor within the room, which room construction comprises as said wall panels, wall panels moulded as a single element from synthetic plastics material in a double skin construction with opposite walls joined at their upstanding edges, said wall panel connecting means being formed at connections between in-line panels as paired single walled moulded panels of synthetic plastics material having coving at their base edges connected to the said wall panels on either side thereof to provide a surface continuous with that of the panels which they join at substantially all positions over the height thereof at least up to ceiling level and to define therebetween service ducts for supply of services to either side of the wall comprised thereby, and said floor construction being formed above said apertures as a perforated false floor positioned over a lower floor, whereby vertical airflow from ceiling to floor is able to take place within a room defined by the room construction, additional coving being moulded on all said panels and providing a rounded transition from the false floor to said panels.

12. The room construction according to claim 11, wherein all said panels are stepped at their coves above the false floor to enable a floor screed to finish flush with the horizontal face of the cover and are stepped forward from the vertical faces of the cove to allow a flooring system to be applied continuously up to the coved surface to end flush with the wall surface of the panels.

13. The room construction according to claim 11, wherein all said panels are formed of glass fibre reinforced plastics material.

* * * * *